United States Patent [19]

Kondo

[11] Patent Number: 4,991,768

[45] Date of Patent: Feb. 12, 1991

[54] SEALED CONTAINER

[75] Inventor: Yoshihito Kondo, Tokushima, Japan

[73] Assignee: Shikoku Kakooki Co., Ltd., Tokushima, Japan

[21] Appl. No.: 938,493

[22] Filed: Dec. 5, 1986

[30] Foreign Application Priority Data

Dec. 6, 1985 [JP] Japan ..... 60-188931[U]

[51] Int. Cl.[5] ..... B65D 5/40

[52] U.S. Cl. ..... 229/137; 229/198.2

[58] Field of Search ..... 229/7 R, 17 R, 48 T, 229/137, 198.2

[56] References Cited

U.S. PATENT DOCUMENTS

| | | | |
|---|---|---|---|
| 3,979,048 | 9/1976 | Stark et al. | 229/48 T |
| 4,267,957 | 5/1981 | Holmström | 229/17 R |
| 4,287,247 | 9/1981 | Reil et al. | 229/48 T |
| 4,511,078 | 4/1985 | Rauser et al. | 229/48 T |

FOREIGN PATENT DOCUMENTS

| | | | |
|---|---|---|---|
| 1257588 | 2/1961 | France | 229/48 T |

*Primary Examiner*—Gary E. Elkins

*Attorney, Agent, or Firm*—Armstrong, Nikaido, Marmelstein, Kubovcik & Murray

[57] ABSTRACT

A sealed container eventually shaped into a rectangular parallelopiped is formed by folding a sheet of blank and joining together the required folded portions. The container has a longitudinal seal portion formed by joining together the longitudinal opposite edge portions of the blank and extending vertically over the rear side of the rectangular parallelopipedal container main body, and upper and lower transverse seal portions formed by sealing the upper and lower ends of the blank as shaped in the form of a tube. The upper and lower seal portions extend sidewise over the top side and bottom side of the main body, respectively, and are folded toward the rear side.

3 Claims, 4 Drawing Sheets

SEALED CONTAINER

BACKGROUND OF THE INVENTION

The present invention relates to a sealed container for containing milk, juice or the like.

Such sealed containers heretofore known include one which comprises a rectangular parallelepipedal container main body 11 provided with two upper and two lower triangular ears 12 and 13 at its upper and lower ends, respectively as seen in FIGS. 4 to 8. When seen from above, the container main body 11 has a larger dimension in the transverse direction perpendicular to the front-to-rear direction indicated by an arrow A in FIG. 4. The main body has a front side 14, rear side 15, opposite lateral sides 16, 17, top side 18 and bottom side 19. The upper triangular ear 12 is integral with the lateral side 16 (17) and the top side 18 at the upper ridge 21 (20) wherebetween, folded downward along the ridge 21 (20) and lapped over and adhered to the lateral side 16 (17). The lower triangular ear 13 is integral with the lateral side 16 (17) and the bottom side 19 at the lower ridge 23 (22) therebetween, folded inward along the ridge 23 (22) over the bottom side 19 and adhered thereto. Stated briefly, this container is formed by a known method comprising the steps of preparing a tube from a web of laminate composed of a paper base sheet and a thermoplastic synthetic resin layer on each surface of the base sheet by lapping the opposite longitudinal edges of the web over each other and sealing the lap, forming an unfinished intermediate container V-shaped in cross section at its upper and lower portions by sealing the tube transversely thereof to obtain a container portion after filling contents into the tube and cutting the sealed area at the center of its width, and making the intermediate container into a complete container by shaping the upper and lower portions flat while forming triangular ears at these portions and folding and adhering the upper and lower triangular ears as stated above. The upper and lower transverse seal portions 24 and 25 formed by transversely sealing the tube extend sidewise over the top side 18 and the bottom side 19, respectively, and further extend at the opposite ends of the container over the upper and lower triangular ears 12 and 13 to the apexes of the triangles. The longitudinal seal portion 26 formed by lapping the longitudinal edges of the web over each other and sealing the lap extends vertically over the rear side 15 at the center of its width, further extends at the upper and lower ends of the rear side 15 over the top side 18 and the bottom side 19 and intersects the upper and lower transverse seal portions 24 and 25 at the opposite ends of the seal portion 26. As shown in detail in FIG. 7, the longitudinal edges 28 and 20 of the container blank providing the longitudinal seal portion 26 are lapped over and joined to each other. Accordingly, if the face 30 of the inner edge 28 is left exposed inside the container, the contents will penetrate into the material of the container through the edge face 30. To prevent this, a seal tape 31 is provided over the lap for covering the edge face 30.

The upper and lower transverse seal portions 24 and 25, which are upstanding and depending when formed by sealing, are folded forward and have their end faces 32 and 33 directed forward. This poses the following problems. First, when the container is seen from the front as shown in FIG. 6, the above-mentioned end faces 32 and 33 directly come into view, rendering the container unsightly. The second problem arises from the upper and lower intersections of the longitudinal seal portion 26 with the upper and lower transverse seal portions 24, 25. With reference to FIG. 8 typically showing the upper intersection, the upper transverse seal portion 24, which was upstanding on sealing, is folded forward, with the result that the seal tape 31 included in the intersection is also folded. The seal tape 31 is folded in such a direction as to loosen the tape 31. The seal tape 31, if loosened, permits the contents to leak and penetrate into the material of the container.

SUMMARY OF THE INVENTION

The main object of the present invention is to provide a sealed container which is free of these problems.

Whereas the upper and lower transverse seal portions of the conventional container are forwardly folded, the present invention provides a sealed container characterized in that these two seal portions are rearwardly folded, whereby the first problem is overcome.

The present invention further provides a sealed container prepared from a blank, wherein the inner surface of one of opposite longitudinal edge portions of the blank is lapped over the outer surface of the other edge portion, and the end face of the inner edge portion is covered with a seal tape affixed to the inner surface of the blank and extending over the edge end face across the end face, whereby the second problem is overcome.

Figure 1:
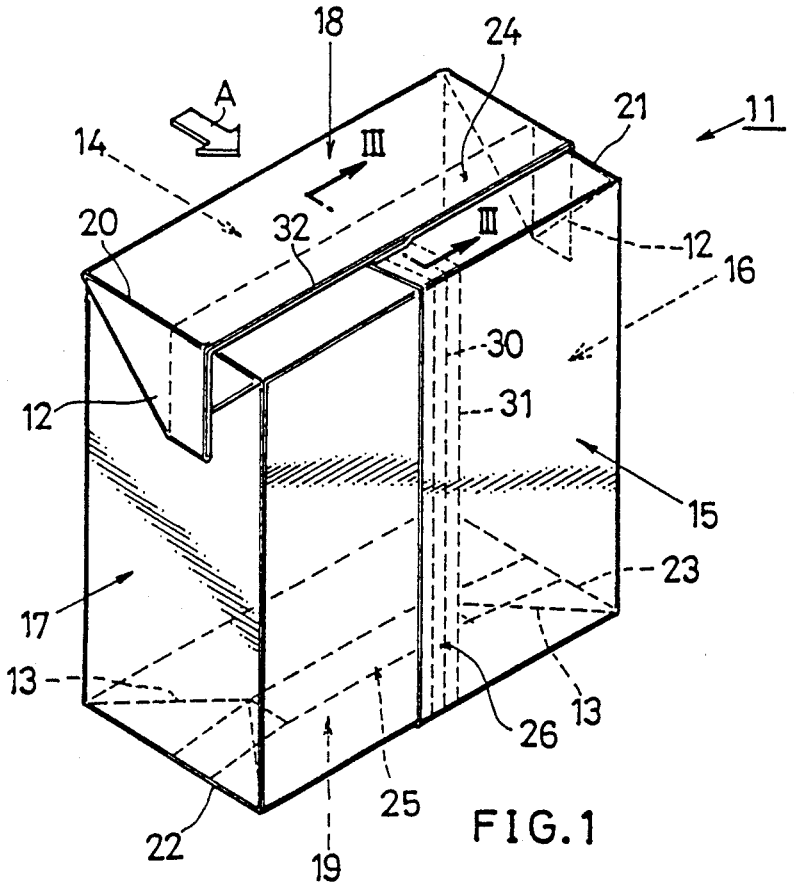
FIG. 1 is a perspective view showing a container embodying the present invention.

The sealed container of the present invention has the same upper and lower transverse seal portions 24 and 25 as the conventional container described above and further has the same components as the conventional one including these seal portions. Accordingly, like parts are designated by like reference numerals throughout the drawings and will not be described. The bottom side view is not given.

Figure 2:
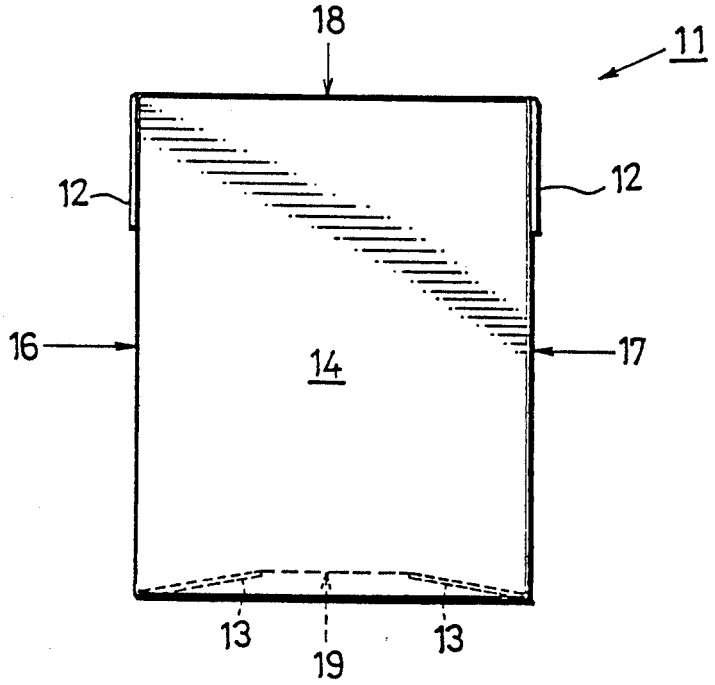
FIG. 2 is a front view of the same.

The upper and lower transverse seal portions 24 and 25 of the present sealed container are folded rearward so that the end faces 32 and 33 of these portions are directed rearward exactly opposite to the conventional folding direction. Consequently, when the container is seen from the front as shown in FIG. 2, the end faces 32 and 33 of the transverse seal portions 24 and 25 are hidden from view and can not be seen from the front side of the container. The container therefore has an improved appearance.

Figure 3:
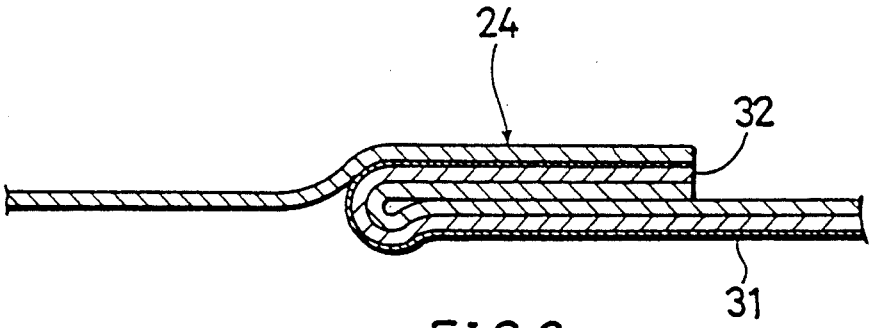
FIG. 3 is an enlarged view in section taken along the line III—III in FIG. 1.
Figure 4:
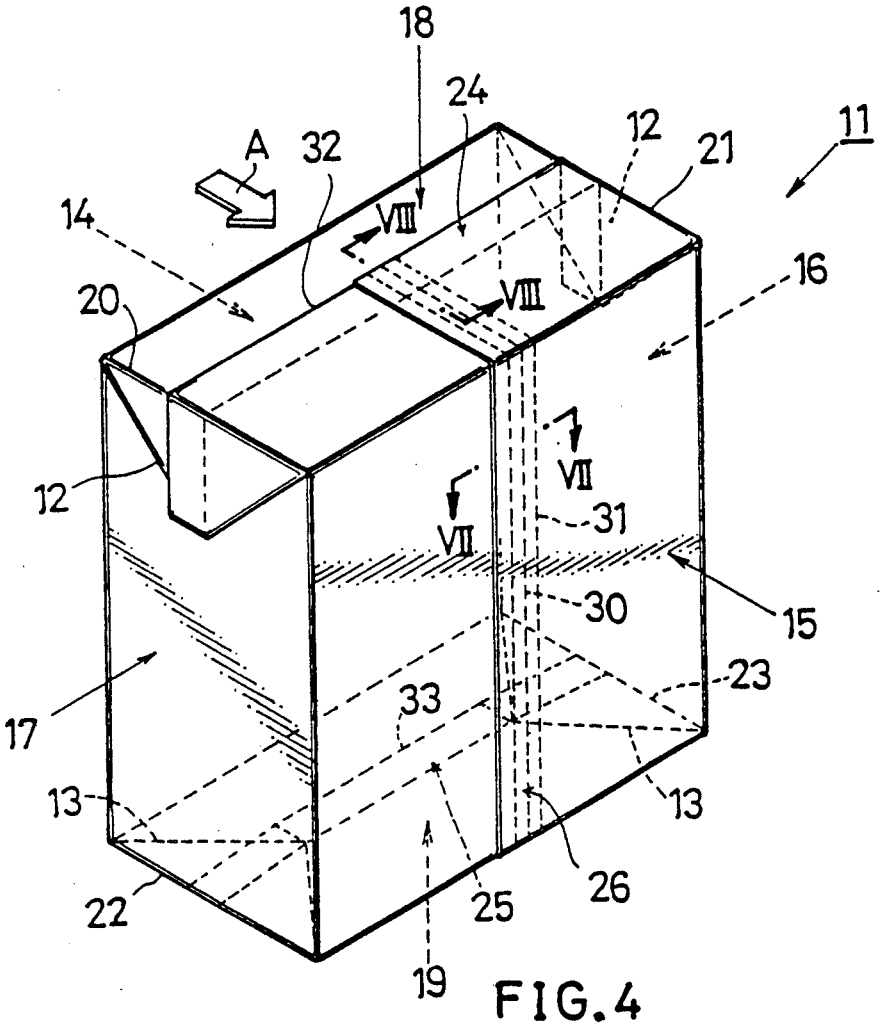
FIG.4 PRIOR ART
FIG. 4 is a perspective view showing a conventional container.
Figure 5:
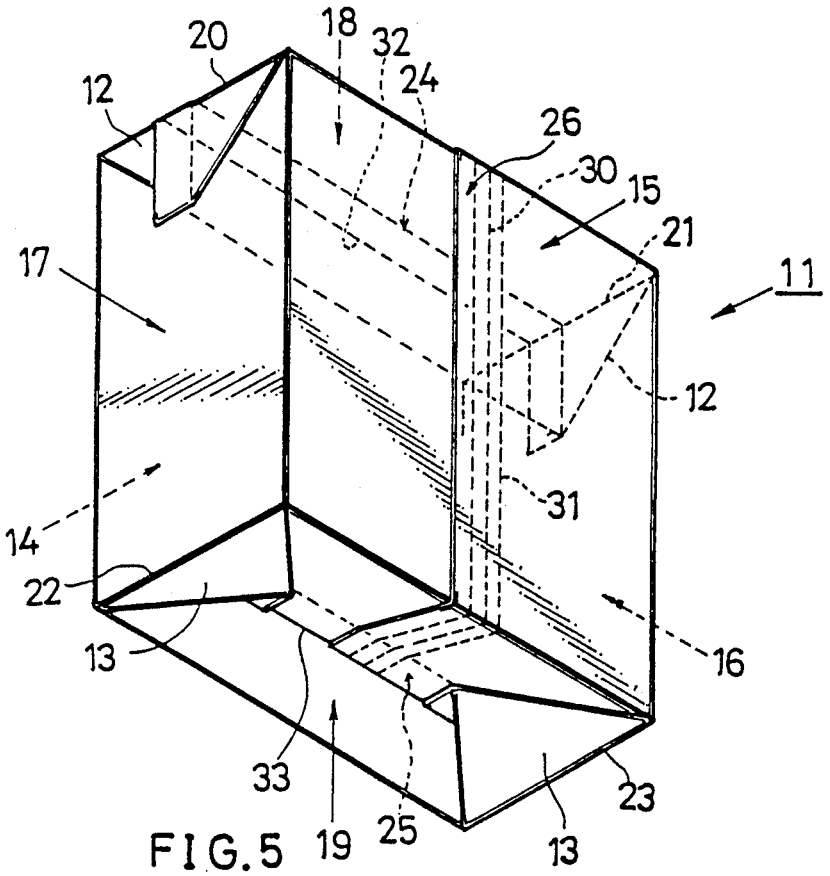
FIG.5 PRIOR ART
FIG. 5 is a perspective view showing the same as it is seen from the bottom side.
Figure 6:
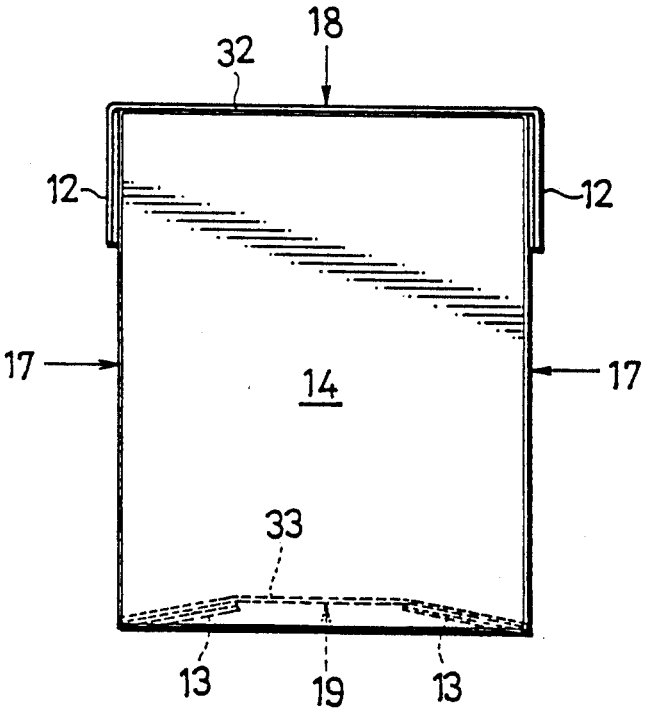
FIG.6 PRIOR ART
FIG. 6 is a front view of the same.
Figure 7:
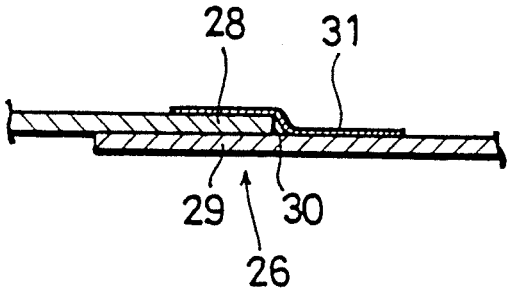
FIG.7 PRIOR ART
FIG. 7 is an enlarged view in section taken along the line VII—VII in FIG. 4.
Figure 8:
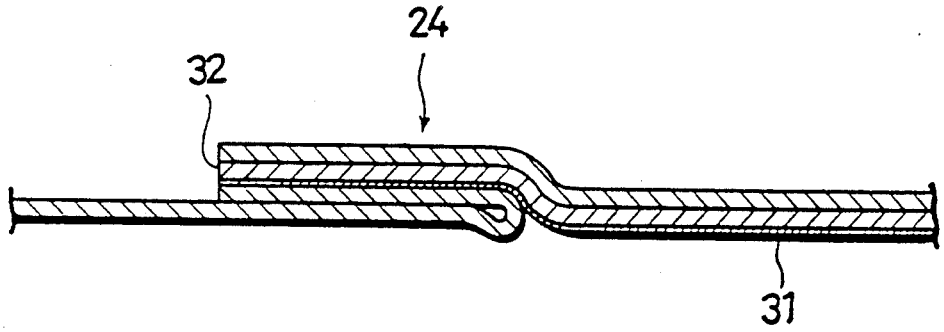
FIG.8 PRIOR ART
FIG. 8 is an enlarged view in section taken along the line VIII—VIII in FIG. 4.

FIG. 3 shows the upper of the upper and lower intersections of the longitudinal seal portion 26 with the upper and lower transverse seal portions 24 and 25. Since the upper transverse seal portion 24 is folded rearward, the illustrated part of the longitudinal seal portion 26 is in the same state as when it is folded over, with the result that the seal tape 31 included in the intersection is tensioned, effectively covering the end face of the longitudinal edge portion of the container blank.

I claim:

1. A sealed container made of a paper base blank having a pair of opposite longitudinal edges, a pair of transverse edges respectively forming a top edge and bottom edge of said blank and a thermoplastic synthetic resin layer on each side thereof and shaped into a rectangular parallelepiped by forming a longitudinal seal by bending the blank into a tubular form with a surface portion of the top and bottom edges opposing another surface portion thereof, lapping the opposite longitudinal edges of the blank over each other to provide two interfacing edge portions with one longitudinal edge and an end face of said longitudinal edge inside the tubular form and joining the edge portions together to form a longitudinal seal, a seal tape affixed to an inner surface of the tubular form and extending across said end face of said longitudinal edge, subsequently fitting and joining the opposed surface portions of said top edge and said bottom edge to form upper and lower transverse seals respectively, said container comprising a main body having a front side, a rear side, opposite lateral sides, a top side and a bottom side, a side ridge between each lateral side and the top and bottom sides, and two upper and two lower triangular ears extending respectively from the two side ridges between the top side and the lateral sides and from the two side ridges between the bottom side and the lateral sides, the upper transverse seal extending sidewise in an upstanding state across the top side between the two upper triangular ears, the lower transverse seal extending sidewise in a depending state across the bottom side between the two lower triangular ears, the longitudinal seal extending vertically across the rear side, the top side and the bottom side to intersect the upper and lower transverse seals, the container being characterized in that the upper and lower transverse seals are folded rearward to direct the top and bottom edges of the blank rearward and fold said tape sealed longitudinal seal intersecting said upper and lower transverse seals back upon itself.

2. A sealed container as defined in claim 1 wherein the upper triangular ears are folded over the opposite lateral sides of the container main body and adhered thereto, and the lower triangular ears are folded over the bottom side of the main body and adhered thereto.

3. A sealed container as defined in claim 1 wherein the longitudinal seal portion extends over the rear side, the top side and bottom side centrally thereof with respect to the sidewise direction.

* * * * *